US008801476B2

(12) United States Patent
Zhang

(10) Patent No.: US 8,801,476 B2
(45) Date of Patent: Aug. 12, 2014

(54) AUDIO JACK CONNECTOR HAVING LOW INSERTION FORCE AND HIGH EJECTION FORCE

(75) Inventor: Wei-De Zhang, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 208 days.

(21) Appl. No.: 13/413,860

(22) Filed: Mar. 7, 2012

(65) Prior Publication Data

US 2012/0231679 A1 Sep. 13, 2012

(30) Foreign Application Priority Data

Mar. 7, 2011 (CN) ..... 2011 2 0057599

(51) Int. Cl.
*H01R 9/24* (2006.01)

(52) U.S. Cl.
USPC ..... 439/884; 439/668; 439/862

(58) Field of Classification Search
CPC ..... H01R 24/58; H01R 2103/00; H01R 2107/00; H01R 2105/00; H01R 13/514; H01R 13/7033; H01R 23/7073; H01R 13/703; H01R 23/26; H01R 24/38; H01R 43/26; H01R 2201/16; H01R 13/2442; H01R 12/57; H01R 12/716; H01R 13/24; H01R 13/11; H01R 13/113
USPC ..... 439/884, 862, 668–669
See application file for complete search history.

(56) References Cited

U.S. PATENT DOCUMENTS

| | | | | |
|---|---|---|---|---|
| 6,056,602 | A * | 5/2000 | Wu | 439/668 |
| 6,270,380 | B1 * | 8/2001 | Shichida et al. | 439/669 |
| 6,551,149 | B2 * | 4/2003 | Orihara | 439/862 |
| 7,568,929 | B1 * | 8/2009 | Su et al. | 439/188 |
| 7,874,876 | B1 * | 1/2011 | Huang | 439/668 |

* cited by examiner

*Primary Examiner* — Xuong Chung Trans
(74) *Attorney, Agent, or Firm* — Ming Chieh Chang; Wei Te Chung

(57) ABSTRACT

An electrical contact (100) of an audio jack connector includes a main portion (10), a soldering portion (30) bending from a lateral edge of the main portion, an elastic portion (20) extending curvedly from a distal end of the main portion to be located above the main portion. The elastic portion has a flexible beam (21), a first arm (22) extending upwardly from the flexible beam and a second arm (23) curvedly bending from the first arm. The first arm and is consistent with a direction along which an audio plug connector is inserted. The second arm is adverse to a direction along which the audio plug connector is withdrawn.

13 Claims, 3 Drawing Sheets

AUDIO JACK CONNECTOR HAVING LOW INSERTION FORCE AND HIGH EJECTION FORCE

BACKGROUND OF THE INVENTION

1. Field of the Invention

The present invention relates generally to an audio jack connector, and more particularly to an audio jack connector having low insertion force and high ejection force.

2. Description of Related Arts

An audio jack connector is usually arranged on an electronic device and an audio plug connector is inserted into the audio jack connector for signal transmission. A user expects low insertion force for facilitating insertion of the audio plug connector. Additionally, high ejection force is expected because the audio jack connector is arranged on peripheral of the electronic device and the audio plug connector may be inadvertently withdrawn from the audio jack connector.

A conditional audio jack connector usually comprises a main portion, a soldering portion bending from an edge of the main portion, an elastic portion extending curvedly from an end of the main portion to be located above the main portion, and a contacting portion formed at the end of the elastic portion. The contacting portion has a first arm upwardly extending from the elastic portion, a curved portion at a highest position, and a second, free arm extending downwardly from the curved portion. The first arm and the second arm are respectively located at opposite sides of the curved portion and the contacting portion defines an opening properly facing to the main portion. The first arm is oblique to be consistent with a first direction along which an audio plug connector is inserted. Therefore, the audio plug connector is guided by the first arm when it is inserted into the audio jack connector. The second arm is oblique, too and is consistent with a second direction along which the audio plug connector is withdrawn. Therefore, the audio plug connector is guided by the second arm when it is withdrawn from the audio jack connector. Generally speaking, the audio jack connector has a low insertion force into which the audio plug connector is conveniently inserted; the audio jack connector also has a low ejection force, resulting in that the audio plug connector may be inadvertently withdrawn from the audio jack connector.

Hence, an audio jack connector which has a low insertion force and a high ejection force is desired.

SUMMARY OF THE INVENTION

Accordingly, an object of the present invention is to provide an audio jack connector which has a low insertion force and a high ejection force.

To achieve the above object, an electrical contact of an audio jack connector includes a main portion, a soldering portion bending from a lateral edge of the main portion, an elastic portion extending curvedly from a distal end of the main portion to be located above the main portion. The elastic portion has a flexible beam, a first arm extending upwardly from the flexible beam and a second arm curvedly bending from the first arm. The first arm and is consistent with a direction along which an audio plug connector is inserted. The second arm is adverse to a direction along which the audio plug connector is withdrawn.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
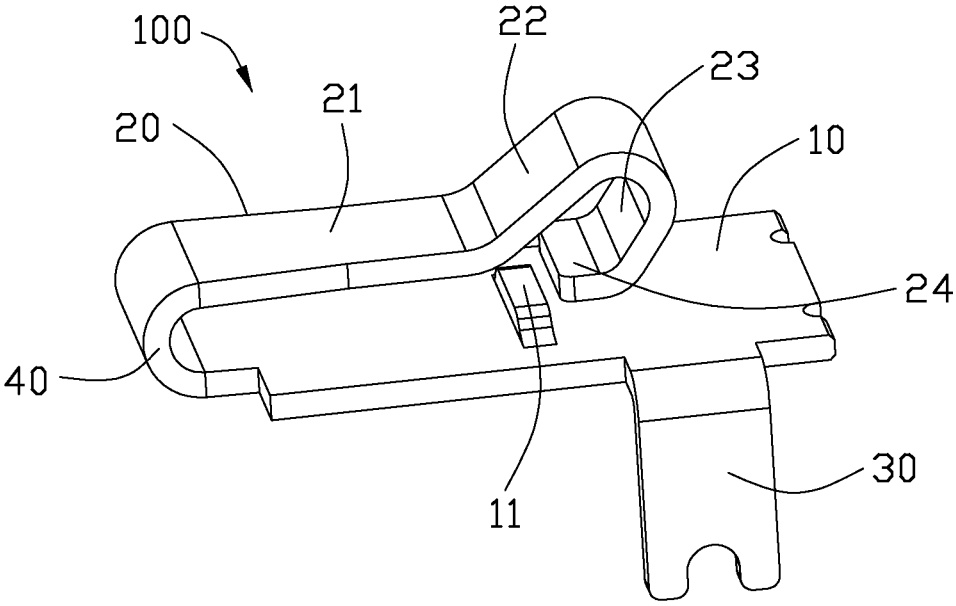
FIG. 1 is a perspective view of an electrical contact of an audio jack connector in a preferred embodiment of the present invention.
Figure 2:
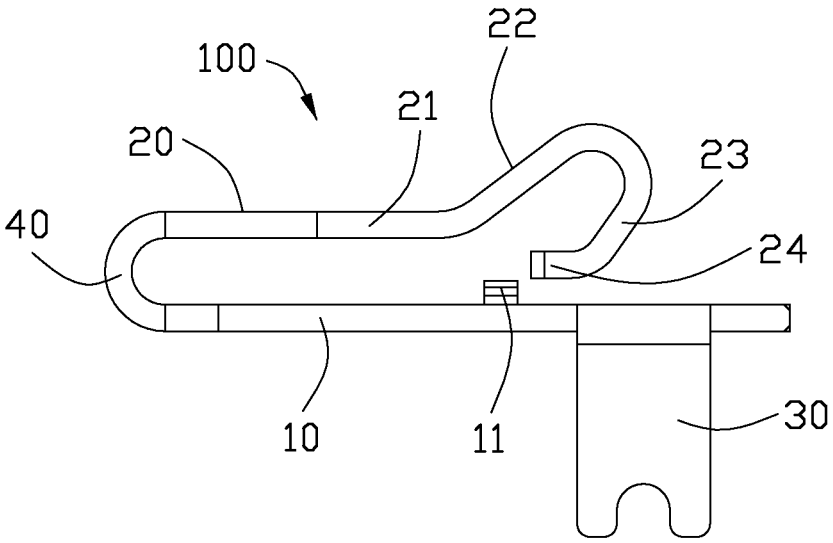
FIG. 2 is a front elevational view of the electrical contact in a natural state.

Referring to FIGS. 1 and 2, an electrical contact 100 of an audio jack connector (not shown) comprises a main portion 10, a soldering portion 30 bending from a lateral edge of the main portion 10, and an elastic portion 20 extending curvedly from a distal end of the main portion 10 to be located above the main portion 10. The elastic portion 20 has a flexible beam 21 parallel to the main portion 10, a first arm 22 extending upwardly from the flexible beam 21, and a second arm 23 curvedly bending from the first arm 22. The first arm 22 and the second arm 23 are both oblique and commonly form a contact section bulged beyond the flexible beam 21 for contact with the plug which is inserted into the housing of the audio jack under condition that the whole contact section essentially defines an arc extending over 270 degrees. The electrical contact 100 comprises an arc portion 40 connecting with the main portion 10 and the flexible beam 21. The electrical contact 100 further comprises a block portion 24 at a free end of the second arm 23 extending towards the arc portion 40. The block portion 24 extends parallel with the main portion 10 and is positioned between the main portion 10 and the elastic portion 20 along a vertical direction. The main portion 10 has a stamped protrusion 11 towards the elastic portion 20 to be pre-connected with the block portion 24. The protrusion 11 is positioned between the arc portion 40 and the block portion 24.

Figure 3:
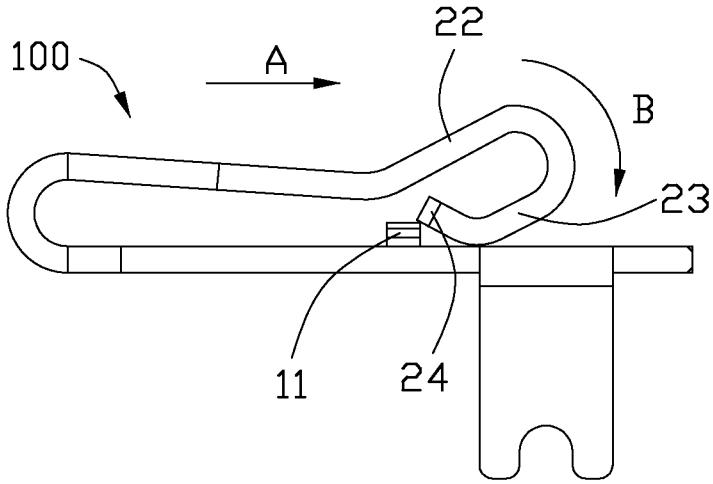
FIG. 3 is a front elevational view of the electrical contact when an audio plug connector is inserted.

Referring to FIG. 3, when the audio plug connector is inserted into the audio jack connector along a first horizontal direction (shown as A), the elastic portion 20 rotates along a second semi-circumferential direction (shown as B). Therefore, the block portion 24 connects with the protrusion 11 and the audio plug connector is prevented from excessively insertion. Because a deformation of the elastic portion 20 is compliant with the direction along which the audio plug connector is inserted, the electrical contact 100 of the present invention provides a low insertion force; and the deformation of the elastic portion 20 is conversed to a direction along which the audio plug connector is withdrawn, a high ejection force is provided to meet the user's expectation. Notably, the first arm 22 and the second arm 23 commonly form another arc portion which is spaced from the arc portion 40 with a distance which is two times over a dimension of either the arc portion 40 or the another arc portion formed by the first arm 22 and the second arm 23.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical contact for use with an electrical connector, comprising:

a planar main portion adapted for retaining to a housing of the connector, the main portion having an upward stamped protrusion;

a front arc portion unitarily extending from a front end of the main portion initially upwardly and further toward a rear end of the main body; and an elastic portion unitarily extending rearwardly from the front arc portion and spaced from the main body, said elastic portion including a flexible beam linked to the front arc portion, and a rear arc portion linked to the flexible beam and forming a contact section bulging upwardly beyond the flexible beam for deflection by an inserted plug to abut against the main portion; wherein the rear arc portion essentially extends initially rearwardly and upwardly and successively downwardly and further forwardly to define a loop like configuration; wherein the protrusion is positioned between the front arc portion and a free end of the rear arc portion along a front-to-back insertion direction, and the free end of the rear arc portion is connected with the protrusion when the plug is inserted to deflect the rear arc portion.

2. The electrical contact as claimed in claim 1, wherein the flexible beam is essentially parallel to the main portion.

3. The electrical contact as claimed in claim 1, wherein the free end of the rear arc portion forms a block portion extending substantially parallel with the planar main portion for abutment with the stamped protrusion on the main portion when the flexible beam is deflected toward the main portion.

4. An electrical contact for use with in an electrical connector, comprising:

a stationary planar main portion adapted for retaining to a housing of the connector;

a front arc portion unitarily extending from a front end of the main portion initially upwardly and further toward a rear end of the main body in a front-to-back direction; and an elastic portion unitarily extending rearwardly from the front arc portion and spaced from the main body, said elastic portion including a flexible beam linked to the front arc portion, and a rear arc portion which is linked to the flexible beam and defines a contact section and essentially extends above the flexible beam for contact with a plug connector at a contacting point, and is adapted to abut against the main portion at an abutment point when the elastic portion is deflected toward the main portion by the plug connector; wherein the front arc portion defines rearward facing opening while the rear arc portion defines a forwardly and downward facing opening; wherein the contacting point and the abutting point are essentially aligned with each other in a vertical direction, which is perpendicular to the front-to-back direction, when the contact is in a relaxed manner, while the abutting point is moved forwardly to be forwardly offset from the contacting point when the elastic portion is deflected toward the main portion by the plug connector so as to form self-rotation of the rear arc portion in a tensioned manner.

5. The electrical contact as claimed in claim 4, wherein the front arc portion and the rear arc portion are spaced from each the via the flexible beam with a distance which is two times over a dimension of either the front arc portion and the rear arc portion along said front-to-back direction.

6. The electrical contact as claimed in claim 4, wherein a block portion is located at a free end of the contact section for abutment with a stamped protrusion on the main portion when the flexible beam is deflected toward the main portion.

7. The electrical contact as claimed in claim 4, wherein the flexible beam is essentially parallel to the main portion.

8. The electrical contact as claimed in claim 4, wherein a solder portion is formed on a rear region of the main portion.

9. The electrical contact as claimed in claim 8, wherein the solder portion is located behind the rear arc portion said front-to-back direction.

10. The electrical contact as claimed in claim 4, wherein the contact section include a first arm with an outer surface facing forwardly and upwardly, and a second arm with another outer surface facing rearwardly.

11. An electrical contact for use with an electrical connector, comprising:

a stationary planar main portion adapted for retaining to a housing of the connector;

a front arc portion unitarily extending from a front end of the main portion initially upwardly and further toward a rear end of the main body; and an elastic portion unitarily extending rearwardly from the front arc portion and spaced from the main body, said elastic portion including a flexible beam linked to the front arc portion, and a rear arc portion which is linked to the flexible beam and defines a contact section and essentially extends above the flexible beam for contact with a plug connector and adapted to abut against the main portion when the elastic portion is deflected toward the main portion by the plug connector; wherein the rear arc portion essentially extends initially rearwardly and upwardly and successively downwardly and further forwardly to define wholly a loop like configuration regardless of whether a forward opening remains around a free end of the rear arc portion or not; wherein a stamped upward protrusion is formed on the main portion, and the rear arc portion contacts the main portion at a first point and contacts the protrusion at a second point around the tip section thereof when the flexible beam is deflected toward the main portion by the plug connector.

12. The electrical contact as claimed in claim 11, wherein the flexible beam is essentially parallel to the main portion.

13. The electrical contact as claimed in claim 11, wherein the front arc portion and the rear arc portion are spaced from each other via the flexible beam with a distance which is more than two times of a dimension of either the front arc portion and the rear arc portion in a front-to-back direction.

* * * * *